US005182995A

United States Patent [19]

Theurer

[11] Patent Number: 5,182,995

[45] Date of Patent: Feb. 2, 1993

[54] RERAILING DEVICE

[75] Inventor: Josef Theurer, Vienna, Austria

[73] Assignee: Franz Plasser Bahnbaumaschinen-Industriegesellschaft m.b.H., Vienna, Austria

[21] Appl. No.: 848,850

[22] Filed: Mar. 10, 1992

[30] Foreign Application Priority Data

Apr. 29, 1991 [AT] Austria ..... 889/91

[51] Int. Cl.[5] ..... E01B 35/00

[52] U.S. Cl. ..... 104/2; 104/263

[58] Field of Search ..... 104/2, 4, 12, 262, 263, 104/273, 307, 7.1, 7.2; 73/146; 33/523.1, 287, 1 Q

[56] References Cited

U.S. PATENT DOCUMENTS

| | | | |
|---|---|---|---|
| 3,143,974 | 8/1964 | Oville | 104/12 |
| 4,111,128 | 9/1978 | Keyes | 104/12 |
| 4,565,133 | 1/1986 | Moore | 104/7.2 |
| 4,654,973 | 4/1987 | Worthy | 33/287 |
| 5,111,749 | 5/1992 | Theurer et al. | 104/263 |

FOREIGN PATENT DOCUMENTS 2927729 2/1980 Fed. Rep. of Germany .

*Primary Examiner*—Mark T. Le

*Attorney, Agent, or Firm*—Marmorek, Guttman & Rubenstein

[57] ABSTRACT

A device for rerailing a tool frame having first and second flange wheels onto the rails of a track, the tool frame being movably connected to a machine frame of a track laying machine, the rerailing device comprising a pair of levers mounted directly on the tool frame for abutting against the rails, a swivel drive for swivelling the first and second levers in a plane extending perpendicular to the longitudinal direction of the track, and a spreading drive connected to the tool frame capable of assuming a blocking position in which the position of the tool frame is fixed and a floating position in which the position of the tool frame is adjustable. The rerailing device further comprises a two-stage height drive for lowering the tool frame from the machine frame in a first stage wherein the first and second levers and the swivel drive cause the tool frame to be centered between the rails, and in a second stage wherein, after the tool frame has been centered between the rails, the flange wheels are lowered onto the rails.

11 Claims, 1 Drawing Sheet

Fig. 1
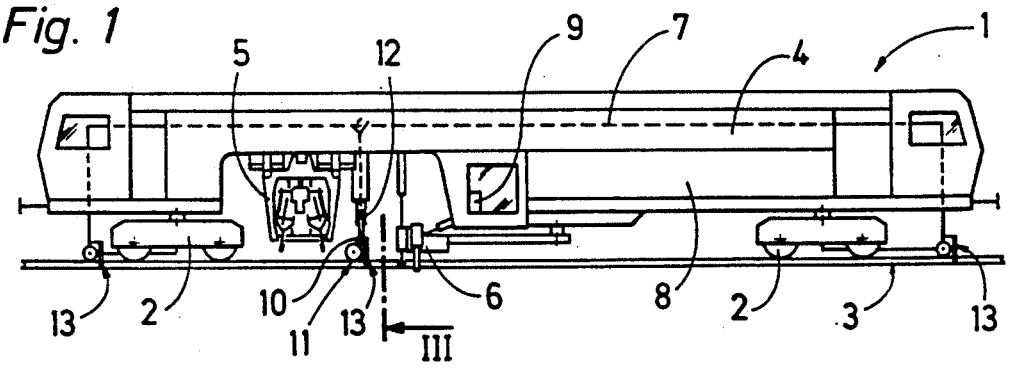
Fig. 3
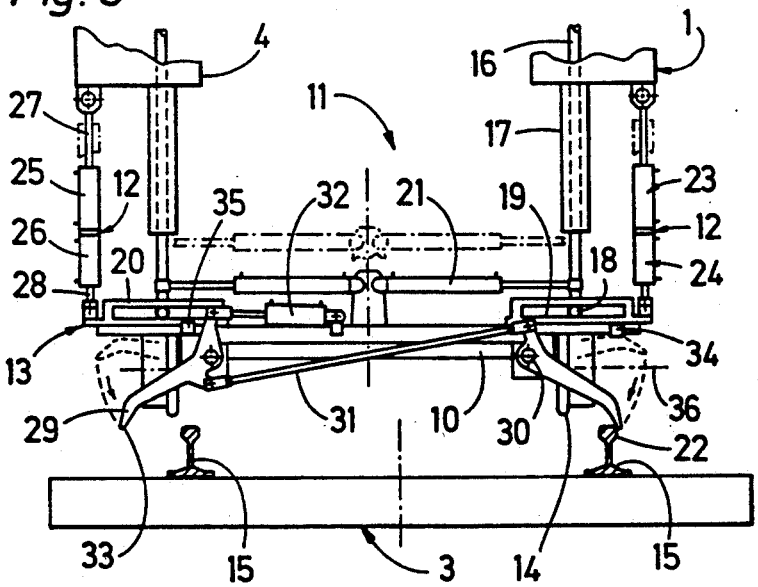
Fig.2
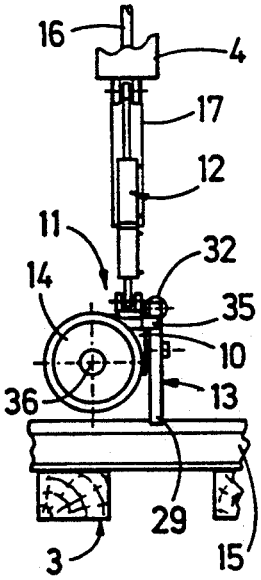
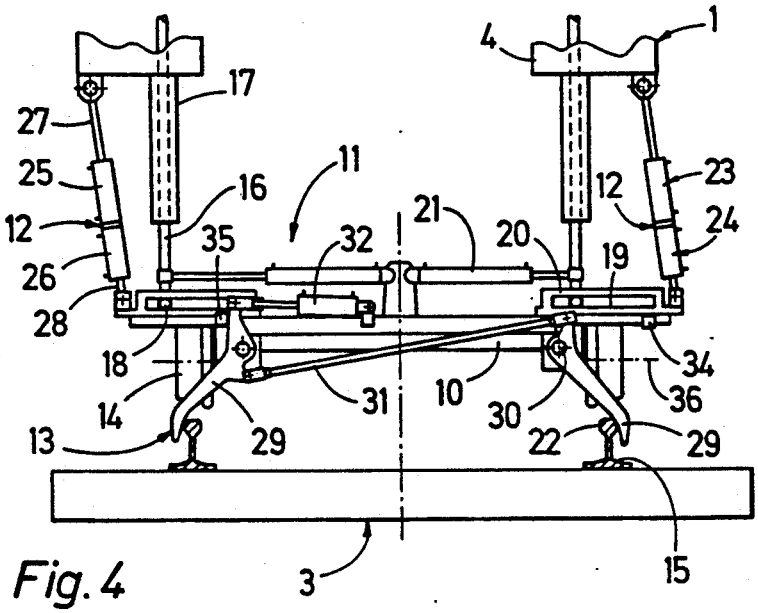
Fig. 4
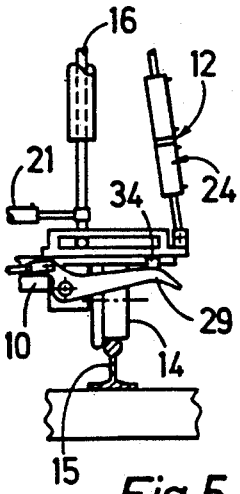
Fig.5

RERAILING DEVICE

BACKGROUND OF THE INVENTION

The invention relates to a device for rerailing a tool frame onto the rails of a track with at least one lever which is intended for abutment against a rail and which is swivellable by a drive in a plane extending perpendicular to the longitudinal direction of the track, in which respect the tool frame which is mobile by flange wheels on the track is connected, hingedly and so as to be adjustable in height by height drives, to a machine frame of a track-laying machine.

There is already known—in accordance with DE-PS 29 27 729—a device for the rerailing or respectively centering of a tool frame of a track-laying machine which is hinged adjustably to a machine frame by height drives. By means of a guide, the tool frame in its raised out-of-operation position is automatically aligned centrally with respect to the center of the machine. The rerailing device hinged independently of the tool frame likewise to the machine frame consists substantially of a pair of levers which are so fastened to a frame of their own, hinged to the machine frame, that the levers are swivellable in a vertical plane extending in the transverse direction of the track. The swivel axes of the levers are, in this respect, spaced horizontally from one another by approximately the gauge of the track. The levers are furthermore coupled to one another by way of a synchronization rod in such a way that the movement of the one lever by means of a swivel drive brings about a movement, mirror-inverted with regard thereto, of the other lever. The free lower ends of the levers are designed as feeler stops for abutment against the rail-head insides. In the rest position of the device the levers are swung up towards the center of the machine. In use the swivel drive is acted upon and there ensues a synchronous spreading movement of the levers in the direction of the insides of the rails heads. If the rerailing device is not centered exactly above the center of the track—e.g. because the machine is located on a track curve—then it leads perforce to the abutment first of all of the one lever against the associated rail head. With progressive spreading of the levers, the frame of the rerailing device is shifted in the direction of the center of the track, until also the other lever butts against the rail head associated with it and the device is thus centered exactly with respect to the center of the track. In this position the frame of the rerailing device then serves to guide the tool frame during its lowering onto the track into the correct track-central position. For this purpose, fastened to the tool frame are finger-like directional supports, which are deflected by guide ramps arranged on the frame of the rerailing device until the flange wheels of the tool frame stand in engagement with the rails and the tool frame is thus rerailed. This rerailing device is constructionally relatively complex and requires an additional frame for the levers.

SUMMARY OF THE INVENTION

The problem of the present invention lies in the provision of a rerailing device, designed constructionally in a particularly simple manner, of the type described at the beginning hereof.

This problem is solved, in accordance with the invention, in that the levers are mounted directly on the tool frame and the height drives are designed for a two-stage lowering of the tool frame, in which respect this is connected to at least one spreading drive for pressing the flange wheels against the rail head.

A rerailing device designed in this way requires in an advantageous manner merely a few structural parts, which are fastenable to the tool frame in a problem-free manner, and without impairing its function. As a result of the lowering movement which is performable in two stages, the tool frame can first of all be brought or respectively lowered out of the transfer position into a position which is particularly favorable for the centering procedure—with the flange wheels that are to be rerailed located just above the rails. After that the centering of the tool frame in the center of the track is effected and then the second stage of the lowering, i.e. the actual rerailing of the flange wheels. In a particularly economical manner, in this respect the spreading drives necessary for the working use of the tool frame are also usable for the performance of the rerailing procedure. This use consists in that the tool frame is blockable until the conclusion of the first stage of the lowering movement or respectively until the levers butt against the rails to avoid an unintentional transverse displacement, possible in particular on banking sections of the track, by means of the spreading drives, so that in these track sections, too, a disturbance-free rerailing procedure is ensured.

In a development of the invention, each height drive comprises upper and lower drives, each of the drives comprising a cylinder unit and a piston unit, the upper and lower drives being connected together coaxially in the region of an end face of their respective cylinder units. The piston units of each upper drive is connected to the machine frame and the piston unit of each of the lower drives is connected to the tool frame. This ensures in a particularly simple manner an automatic and exact height positioning of the flange wheels, that are to be rerailed, just above the rails, in that the stroke of the piston units of the upper drives provided for the first lowering stage is dimensioned accordingly. This ensures, moreover, that for the subsequent centering procedure which is triggerable by the swivelling of the levers at all times the same pre-requisites prevail or respectively the lowering is always stopped in the same position of the tool frame.

In this design, the stroke of the piston unit of the upper drive is such that upon maximum stroke, the running surfaces of the flange wheels of the tool frame come to rest approximately 5 to 8 cms above the upper edge of the rails. This device provides the ideal, most extensively unimpeded initial position of the tool frame with respect to the rails for the subsequent centering in the center of the track.

In a further development of the device, the levers are configured for abutment against the outside of the rail heads and are interconnected by a synchronization rod. This makes possible in a most simple manner, the automatic centering of the tool frame onto the rails by the action of only a single drive, since the two levers coupled to one another are swivelled in a mirror-inverted manner with regard to one another in a pincer-like movement.

The arrangement of two swivel pins on which the levers are mounted at a distance from each other which is less than the distance between the two flange wheels affords the advantage that the levers even in their outwardly and upwardly swung end position are still located fully inside the machine profile and cannot cause any kind of impairment of safety.

The design of the levers is such that they each have a free end which is curved in the direction of the center of the track makes possible an improved support of the levers against the rail heads and affords a more secure hold during the centering procedure.

If the angle between the curved end and the subsequent part of the lever amounts to about 150°, this ensures the best possible adaptation of the shape of the lever to the rail-head profile, without in this respeot impairinq the swivellability for the centering procedure.

The further development of the invention wherein the swivel pins are arranged approximately at the same height as an axle on which the two flange wheels are mounted makes possible the most advantageous combination of optimally selected length of the levers on the one hand with maximum lever effect or respectively force development on the other hand for the problem-free performance of the centering of the tool frame.

A limit switch may also be provided which ensures with the most possible means in an automatic switch-over from a blocking position—necessary during the first lowering stage of the tool frame—of the spreading drives into a floating position which is necessary for the centering procedure, so that for the entire centering procedure no intervention of an operator is necessary.

A similar advantage is finally achieved with a second limit switch which automatically triggers the second stage lowering by the height drives upon conclusion of the centering procedure so that in a time-saving manner the rerailing of the tool frame after centering has been effected is concluded automatically and without the necessity of a further intervention on the part of the operator.

BRIEF DESCRIPTION OF THE DRAWINGS

The invention will be described in more detail hereunder with reference to an exemplified embodiment which is shown in the drawings.

FIG. 1 shows a side view of a track-laying machine equipped with the device in accordance with the invention, FIG. 2 shows an enlarged detail side view of the device in FIG. 1, FIGS. 3 and 4 each shows a view in accordance with the arrow III in FIG. 1, of the device in different phases of the rerailing procedure, and FIG. 5 shows a view of a part of the device in the end position after rerailing has been effected.

DETAILED DESCRIPTION OF THE INVENTION

A mobile track-laying machine 1 evident in FIG. 1 has a bridge-shaped machine frame 4 which is mounted at its end on a track 3 by means of rail bogies 2. Arranged thereon for the performance of track-laying works are packing units 5 which are substantially adjustable in height and laterally, a track raising and aligning unit 6 having raising and aligning drives as well as a levelling and aligning reference system 7 controlling these units. A central power unit 8 serves for the supply of all of the drives which are arranged on the track-laying machine 1 and which are controllable by way of a control mechanism 9 located in a work cab. Provided for ascertaining the position of the track 3 is a measuring trolley 11 which is rollable on the track and which has a tool frame 10 and which is connected between the rail bogies 2, placed at a distance far from one another, hingedly and adjustable in height by way of height drives 12 to the machine frame 4 and is associated with the levelling and aligning reference system 7. For the purpose of centering upon rerailing, the tool frame 10 is equipped with a rerailing device 13, which will be explained subsequently. Measuring wheels, arranged on the front and rear end of the track-laying machine 1, of the levelling and aligning reference system are likewise provided with a rerailing device 13.

As can be seen in FIG. 2, but in particular in FIGS. 3 and 4, the tool frame 10 of the measuring trolley 11, extending transversely to the longitudinal direction of the track, is connected to two flange wheels 14, which are respectively associated with a rail 15 of the track 3 or are respectively rollable thereon. Provided for the registering of the rail level by the levelling and aligning reference system 7 are two levelling rods 16 which are placed at a distance from one another in the gauge in the transverse direction of the track and which are mounted on the machine frame 4 in a vertical guide 17 and which are freely movable only heightwise. The lower ends of these levelling rods 16 are supported by means of a spar 18 on a horizontal slideway 19 on the tool frame 10 and are mounted in a transverse guide, whereby the tool frame 10 is displaceable relative to the levelling rods 16 or respectively the machine frame 4 in an unimpeded manner in the transverse direction of the track. Two spreading drives 21 arranged horizontally and in the transverse direction of the track are connected by their one end approximately in the center of the machine to the tool frame 10 and by the other end respectively to a levelling rod 16 and have the function, in working use, i.e., after the flange wheels 14 have been lowered onto the rails 15, to press one of the flange wheels 14 in a playfree manner against a rail head 22 of a rail 15.

The height drives 12 connecting the tool frame 10 hingedly to the machine frame 4 are respectively composed of two drives 23, 24, wherein each has a cylinder unit 25, 26 as well as a piston unit 27, 28 and which are connected coaxially to one another in the region of an end face of the two cylinder unit 25, 26. The piston unit 27 of the upper drive 23 is, in this respect, hinged to the machine frame 4, whilst the piston unit 28 of the lower drive 24 is respectively fastened hingedly to an end, on the outside of the machine, of the tool frame 10. Furthermore, the stroke of the piston unit 27 of the upper dive 23 is so dimensioned that, with the piston fully run-out, the tool frame 10 is lowered to such an extent that the flange wheels 14 are situated with their running surfaces about 5 to 8 cm above the rail head 22.

The rerailing device 13 has two levers 29 which are respectively associated with a rail 15 and which are mounted with the aid of pins 30 on the tool frame 10 and are swivellable about a plane extending perpendicular to the longitudinal direction of the track, in which respect the pins 30 are located approximately at the same height as the axles 36 of the flange wheels 14 and the distance of the pins from one another is less than the distance of the flange wheels from one another. The levers 29 are coupled hingedly to one another by means of an approximately diagonally extending synchronization rod 31 in such a way that a movement of the one lever 29 results in a mirror-inverted movement—with respect to a vertical plane extending in the longitudinal axis of the machine—of the other lever. Serving for the performance of this movement or respectively swivelling of the levers 29 is a swivel drive 32 which is hinged to the tool frame 10.

The lower, free ends 33 of the levers 29 are—considered in the downwardly swung end position of the levers curved in the direction of the center of the track and are intended for abutment against the outside of the rail head 22. In this respect, the angle between this curved end 33 and the subsequent main part of the lever 29 amounts to about 150°.

Furthermore, the tool frame 10 is equipped with a limit switch 34, which is contacted by a lever 29 in the end position swung-up to the outside of the machine and communicates with the control of the spreading drives 21, as well as with a further limit switch 35 for abutment against a lever 29 in the lower end position, wherewith the acting-upon of the lower drives 24 is initiated.

The mode of operation of the described device is as follows (see on this score FIG. 3 and FIG. 4): During the transfer travel of the track-laying machine 1, the tool frame 10 or respectively the measuring trolley 11—with the height drives completely withdrawn —is situated in an upper end position, in which it is centered and locked by means of a mechanical guide, not shown here, on the machine frame 4 (see the contour, indicted by dot-dash lines, in FIG. 3). The levers 29 are, in this respect, likewise swung up into the end position. After reaching the place of use the locking of the tool frame 10 is released, whilst the spreading drives 21 are blocked, in order to prevent an undesired lateral pendulating-out of the tool frame upon superelevation, present on track curves, of the track 3. Then the tool frame 10 is lowered by complete running-out of the upper drives 23 in a first step, after which the flange wheels 14 are situated a few centimeters above the rail upper edges.

Now the centering procedure is effected by actuating the swivel drive 32 and synchronous swinging-down of the two levers (see FIG. 3). In this way, also the limit switch 34 is triggered and brings about a temporally slightly delayed chang-eover of the spreading drives 21 from a blocking position into a floating position, in order to make possible a transverse displacement of the tool frame 10 for the purpose of centering in the track 3. If the track-laying machine 1 is situated, as shown here, on a track curve, then perforce the curve-outsidedly situated lever 29 comes first of all into abutment against a rail head 22. With progressive swivelling of the levers 29 it leads to a displacement movement of the tool frame 10 (in the direction of the rail detected first of all), which is concluded at the instant when both levers 29 butt securely against both rail heads 22. Now the flange wheels 14 are situated directly above the rails 15 or respectively the tool frame 10 is centered in the center of the track. This position is shown in FIG. 4.

The limit switch 35 actuated in this end position of the levers 29 now automatically triggers the second stage of the lowering of the tool frame 10 by running out of the lower drives 24, in which respect at the same time also the levers 29 are opened again or respectively swung up, until the flange wheels 14 stand in engagement with the rails 15 and the rerailing is concluded (see FIG. 5).

The described rerailing device is naturally suitable equally also for use in conjunction with other tools or respectively work units of track-laying machines, such as e.g. a track lifting end aligning unit.

While the invention has been described by reference to specific embodiments, this was for purposes of illustration only. Numerous alternative embodiments will be apparent to those skilled in the art and are considered to be within the scope of the invention.

I claim:

1. A device for rerailing a tool frame having first and second flange wheels onto the rails of a track, said tool frame being movably connected to a machine frame of a track-laying machine, said rerailing device comprising first and second lever means mounted directly on said tool frame for abutting against said rails, swivel drive means for swivelling said first and second lever means in a plane extending perpendicular to the longitudinal direction of the track thereby causing said tool frame to be centered between said rails with said flange wheels directly above said rails, and first and second two-stage height drive means for lowering said tool frame froms aid machine frame in a first stage wherein said first and second lever means and said swivel drive means cause said tool frame to be centered between said rails, and in a second stage wherein, after said tool frame has been centered between said rails, said flange wheels are lowered onto said rails.

2. The rerailing device of claim 1 wherein each of said two-stage height drive means comprises upper and lower drives, each of said drives comprising a cylinder unit and a piston unit, said upper and lower drives being connected together coaxially in the region of an end face of their respective cylinder units, the piston unit of the upper drive being connected to said machine frame and the piston unit of the lower drive being connected to said tool frame.

3. The rerailing device of claim 2 wherein the piston unit of the upper drive has a maximum stroke such that said flange wheels of said tool frame come to rest approximately 5 to 8 cms above an upper edge of said rails.

4. The rerailing device of claim 1 wherein each of said first and second lever means is configured to abut against the outside of a rail head of said rails, and wherein said rerailing device further comprises a synchronization rod connecting said first and second lever means together.

5. The rerailing device of claim 1 further comprising first and second swivel pins on which said first and second lever means are mounted directly to said tool frame, the distance between said first and second swivel pins being less than the distance between said first and second flange wheels mounted on said tool frame.

6. The rerailing device of claim 1 wherein each of said first and second lever means includes a free end which is curved in the dirction of the center of said track.

7. The rerailing device of claim 6 wherein said free end is curved at an angle of about 150° to the remainder of said lever means.

8. The rerailing device of claim 1 further comprising first and second swivel pins on which said first and second lever means are mounted directly on said tool frame, said first and second swivel pins being arranged approximately at the same height as an axle on which said first and second flange wheels are mounted.

9. The rerailing device of claim 1 further comprising a spread drive connected to said tool frame, said spread drive being capable of assuming a blocking position wherein the position of the tool frame is fixed and a floating position wherein the position of said tool frame is adjustable.

10. The rerailing device of claim 9 further comprising first limit switch means associated with said first and second lever means for effecting a changeover in said spread drive from said blocking position into said floating position when one of said first and second lever means comes out of abutment against said first limit switch means.

11. The rerailing device of claim 10 further comprising second limit switch means associated with said first and second lever means for effecting said second stage lowering of said tool frame by said first and second two-stage height drive means when one of said first and second lever means comes into abutment against said second limit switch means.

* * * * *